US005663025A

United States Patent [19]

Ciccarelli et al.

[11] Patent Number: 5,663,025

[45] Date of Patent: *Sep. 2, 1997

+

[54] MAGENTA TONER AND DEVELOPER COMPOSITIONS

[75] Inventors: Roger N. Ciccarelli, Rochester; Thomas R. Pickering, Webster; Jacques C. Bertrand, Ontario, all of N.Y.

[73] Assignee: Xerox Corporation, Stamford, Conn.

[ * ] Notice: The term of this patent shall not extend beyond the expiration date of Pat. No. 5,534,379.

[21] Appl. No.: 332,313

[22] Filed: Oct. 31, 1994

[51] Int. Cl.[6] ..... G03G 9/09; G03G 13/16; G03G 9/097

[52] U.S. Cl. ..... 430/106; 430/110; 430/126; 430/137

[58] Field of Search ..... 430/106, 110, 430/137, 126

[56] References Cited

U.S. PATENT DOCUMENTS

| | | | |
|---|---|---|---|
| 3,590,000 | 6/1971 | Palermiti et al. | 252/62.1 |
| 4,338,390 | 7/1982 | Lu | 430/106 |
| 4,560,635 | 12/1985 | Hoffend et al. | 430/106.6 |
| 4,758,493 | 7/1988 | Young et al. | 430/122 |
| 4,760,009 | 7/1988 | Larson | 430/137 |
| 4,847,177 | 7/1989 | Raue et al. | 430/106 |
| 4,935,326 | 6/1990 | Creatura et al. | 430/108 |
| 5,137,576 | 8/1992 | Macholdt et al. | 430/106 |
| 5,194,356 | 3/1993 | Sacripante et al. | 430/106 |
| 5,223,368 | 6/1993 | Ciccarelli et al. | 430/110 |
| 5,324,613 | 6/1994 | Ciccarelli et al. | 430/110 |
| 5,427,884 | 6/1995 | Ohtani et al. | 430/110 |
| 5,486,443 | 1/1996 | Grande et al. | 430/106 |
| 5,534,379 | 7/1996 | Dalal et al. | 430/106 |

FOREIGN PATENT DOCUMENTS

| | | | |
|---|---|---|---|
| 1-154161 | 6/1989 | Japan | 430/106 |
| 5-11504 | 1/1993 | Japan | 430/110 |

OTHER PUBLICATIONS

G. Wyszecki et al. *Color Science,* 2nd Ed. John Wiley & Sons (Nov. 1982) pp. 164–169, 825–830.

R.W.G. Hunt, *Measuring Color,* John Wiley & Sons (Dec. 1987) pp. 62–69.

F.W. Billmeyer, Jr. et al. *Principles of Color Technology* 2nd Ed., John Wiley & Sons (May 1981) pp. 25–110.

Minolta, "Precise Color Communication" (1994) pp. 18, 20, 45–49.

CAS Registry No. 980–26–7.

*Primary Examiner*—Janis L. Dote
*Attorney, Agent, or Firm*—E. O. Palazzo

[57] ABSTRACT

A toner composition comprised of resin particles, first magenta pigment particles of a molydate silicate salt of rhodamine, and second magenta pigment particles of a 2,9-dimethylquinacridone; and wherein the first pigment is present in an amount of from about 0.5 to about 1.2 weight percent, and the second pigment is present in an amount of from about 1.5 to about 10.2 weight percent.

25 Claims, No Drawings

MAGENTA TONER AND DEVELOPER COMPOSITIONS

BACKGROUND OF THE INVENTION

The invention is generally directed to toner and developer compositions, and more specifically, the present invention is directed to developer and toner compositions containing a mixture of certain pigments and optional charge enhancing additives, which impart or assist in imparting a triboelectric charge to the toner resin policies and enable toners with rapid admix characteristics. In embodiments, there are provided in accordance with the present invention toner compositions comprised of resin policies, first pigment policies of Pigment Red 81:3 (C.I #45160:3 which is a molybdate silicate salt of Rhodamine), and second pigment policies of a metal free pigment like Pigment Red 122 (C.I. #73915, 2,9-dimethylquinacridone). More specifically, the first pigment is present in an important amount of from about 0.5 to about 1.2 and preferably about 1 weight percent, and the second pigment is present in an amount of from about 1.5 to about 10.2 and preferably from about 1.8 to about 7.9 weight percent, with the exact amount, or concentration determined by the average mass per unit area of the image developed in the xerographic printing process. Advantages associated with the toners of the present invention include more precise control of the toner triboelectric characteristics, and the use of less pigment which contains the metal molybdenum, which metal can be considered hazardous, while maintaining substantially all of the color characteristics of Pigment Red 81:3. Thus, far example, by reducing the amount of FANAL PINK®, which is a Pigment Red 83:1 and a current commercial toner magenta pigment, California waste disposal requirements will be satisfied it is believed. In embodiments, the amount of FANAL PINK® selected, which also functions as a toner positive charge enhancing additive, can be reduced by almost two thirds. The aforementioned toners in embodiments of the present invention enable, for example, toners with rapid admix of less than about 15 seconds, and more specifically, from about 1 to about 15 seconds in embodiments, extended developer life, stable electrical properties, high image print quality with substantially no background deposits, brilliant magenta color, and compatibility with fuser rolls including VITON® fuser rolls. The toner compositions of the present invention in embodiments thereof possess excellent admix characteristics as indicated herein, and maintain their triboelectric charging characteristics for an extended number of imaging cycles exceeding, for example, 1,000,000 in a number of embodiments. The toner and developer compositions of the present invention can be selected for electrophotographic, especially xerographic, imaging and printing processes, including color processes.

Toner compositions with pigments such as FANAL PINK® or HOSTAPERM PINK® are known. However, these toners possess disadvantages, such as poor to acceptable tribo after extended use, and the amount of metal, about 0.89 to 1.49 percent molybdenum, present in the toner and originating from the FANAL PINK® does not, it is believed, meet California waste disposal requirements. HOSTAPERM PINK™ (Pigment Red 122) alone has a poor magenta color when compared to a FANAL PINK® (Pigment Red 81:3) containing toner. These and other disadvantages are avoided or minimized with the toners of the present invention.

Encompassed within the scope of the present invention are colored toner and developer compositions comprised of toner resin particles, optional carrier particles, the charge enhancing additives illustrated herein, and as pigments or colorants magenta particles, or mixtures thereof, which toners and developers useful with other process colors such as cyan toner and yellow toners. More specifically, with regard to the generation of color images utilizing the toner and developer composition illustrative, examples of magenta materials that may be selected as pigments include, for example, Pigment Red 81:3 and Pigment Red 122. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, Permanent Yellow FGL, and Pigment Yellow 185. The aforementioned pigments are incorporated into the toner composition in various suitable effective amounts as illustrated herein.

Toner and developer compositions with charge enhancing additives, which impart a triboelectric positive or negative charge to the toner resin, are known. Thus, for example, there is described in U.S. Pat. No. 3,893,935 the use of quaternary ammonium salts as charge control agents for electrostatic toner compositions. In this patent, there are disclosed quaternary ammonium compounds with four R substituents on the nitrogen atom, which substituents represent an aliphatic hydrocarbon group having 7 or less, and preferably about 3 to about 7 carbon atoms, including straight and branch chain aliphatic hydrocarbon atoms, and wherein X represents, an anionic function including, according to this patent, a variety of conventional anionic moieties, such as halides, phosphates, acetates, nitrates, benzoates, methylsulfates, perchloride, tetrafluoroborate, benzene sulfonate, and the like; U.S. Pat. No. 4,221,856 which discloses electrophotographic toners containing resin compatible quaternary ammonium compounds in which at least two R radicals are hydrocarbons having from 8 to about 22 carbon atoms, and each other R is a hydrogen or hydrocarbon radical with from 1 to about 8 carbon atoms, and A is an anion, for example sulfate, sulfonate, nitrate, borate, chlorate, and the halogens such as iodide, chloride and bromide, reference the Abstract of the Disclosure and Column 3; a similar teaching is presented in U.S. Pat. No. 4,312,933 which is a division of U.S. Pat. No. 4,291,111; and similar teachings are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on negatively charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, other documents disclosing positively charged toner compositions with charge control additives include U.S. Pat. Nos. 3,944,493; 4,007,293; 4,079,014; 4,394,430, and 4,560,635 which illustrates a toner with a distearyl dimethyl ammonium methyl sulfate charge additive. One disadvantage associated with the charge additive of the '635 patent resides in its apparent inherent instability in some instances, thus rendering it substantially unsuitable as a bulk toner constituent in imaging processes, as the additive can thermally and chemically degrade, and react with other toner components.

Moreover, toner compositions with negative charge enhancing additives are known, reference for example U.S. Pat. Nos. 4,411,974 and 4,206,064, the disclosures of which are totally incorporated herein by reference. The '974 patent discloses negatively charged toner compositions comprised of resin particles, pigment particles, and as a charge enhancing additive ortho-halo phenyl carboxylic acids. Similarly, there are disclosed in the '064 patent toner compositions with chromium, cobalt, and nickel complexes of salicylic acid as negative charge enhancing additives. Also, toners with negative charge additives are illustrated in U.S. Pat. Nos. 4,845,003; 4,758,493; 4,433,040; 5,223,368 and 5,324,613, the disclosures of which are totally incorporated herein by reference. These additives, such as the ALOHAS, an aluminum salt of substituted carboxylic acid, of the latter two patents, can be selected as charge enhancing agents for the toners of the present invention.

in some of the aforementioned patents and other patents, toners with certain colored pigments of magenta, cyan, yellow, green, blue, red, brown, and mixtures thereof are disclosed.

Rhodamines are illustrated in copending application U.S. Ser. No. 331,444, now U.S. Pat. No. 5,486,443 the disclosure of which is totally incorporated herein by reference.

SUMMARY OF THE INVENTION

It is an object of the present invention to provide toner and developer compositions with many of the advantages illustrated herein.

In another object of the present invention there are provided positively or negatively charged toner compositions useful for the development of electrostatic latent images.

In yet another object of the present invention there are provided relatively hazard free toner compositions.

In yet another object of the present invention there are provided toners with excellent magenta color.

Another object of the present invention resides in providing toner compositions with mixtures of magenta pigments, and which mixtures contain certain important, and in embodiments, critical amounts of a first and second pigment.

Another object of the present invention resides in providing toner compositions with reduced amounts of FANAL PINK® (Pigment Red 81:3).

Also, in another object of the present invention there are provided developer compositions.

In yet a further object of the present invention there are provided humidity insensitive, from about, for example, 20 to 80 percent relative humidity at temperatures of from 60° to 80° F. as determined in a relative humidity testing chamber magenta toner compositions with desirable admix properties of 5 seconds to 60 seconds as determined by the charge spectrograph, and preferably less than 15 seconds, for example, and more preferably from about 1 to about 14 seconds, and acceptable triboelectric charging characteristics of from about 10 to about 40 microcoulombs per gram, and wherein the magenta pigment also functions as a charge enhancing additive.

Another object of the present invention resides in the formation of toners which will enable the development of images in electrophotographic imaging apparatuses, which images have substantially no background deposits thereon, are substantially smudge proof or smudge resistant, and, therefore, are of excellent resolution; and further, such toner compositions can be selected for high speed electrophotographic apparatuses, that is those exceeding 70 copies per minute.

These and other objects of the present invention can be accomplished in embodiments thereof by providing toner compositions comprised of resin particles, and magenta pigment particles. More specifically, the present invention in embodiments is directed to toner compositions comprised of resin, a first pigment of Pigment Red 81:3, for example FANAL PINK® and a second pigment of Pigment Red 122, for example HOSTAPERM PINK EB™. In embodiments, the present invention directed to a toner composition comprised of resin particles, first magenta pigment particles of Pigment Red 81:3, that is C.I #45160:3 which is a molybdate silicate salt of Rhodamine, and second magenta pigment particles of Pigment Red 122, that is C.I. #73915, 2,9-dimethylquinacridone, and wherein the first pigment is present in an amount of from about 0.5 about 1.2 weight percent, and the second pigment is present in an amount of from about 1.5 to about 10.2 weight percent.

In embodiments of the present invention, there are provided toners and processes thereof wherein a toner composition comprised of resin particles, first magenta pigment particles a molybdate silicate salt of rhodamine, and second magenta pigment particles comprised of a 2,9-dimethylquinacridone; and wherein the first pigment is present in an amount of from about 0.8 to about 1.1 weight percent, and the second pigment is present in an amount of from about 1.8 to about 7.9 weight percent, and wherein said molybdate silicate salt of rhodamine is Pigment Red 81:3 with a CI number of 45160:3, and wherein said 2,9-dimethylquinacridone is Pigment Red 122 with a CI number of 73915; a toner composition further containing a negative charge enhancing additive; a toner composition wherein the charge additive is present in an amount of from about 0.05 to about 5 weight percent; a toner composition with an admix time of from less than about 15 seconds; a toner composition with an admix time of from about 1 to about 14 seconds; a toner composition wherein the resin particles are comprised of styrene polymers, polyesters, or mixtures thereof; a toner composition wherein the resin particles are comprised of styrene polymers, polyesters, or mixtures thereof; a toner composition wherein the resin particles are comprised of styrene acrylates, crosslinked polyesters, styrene methacrylates, or styrene butadienes; a toner composition further containing a wax component with a weight average molecular weight of from about 1,000 to about 10,000; a toner composition further containing as external additives metal salts of a fatty acid, metal oxides, silicas, or mixtures thereof; a developer composition wherein the carrier particles are comprised of a core with a polymer coating thereover; a method of imaging which comprises formulating an electrostatic latent image on a photoreceptor, affecting development thereof with the toner composition of the present invention, and thereafter transferring the developed image to a substrate; a method of imaging which comprises formulating an electrostatic latent image on a negatively charged photoreceptor, affecting development thereof with the toner composition of the present invention, and thereafter transferring the developed image to a substrate;process for reducing the metal content in a toner by providing a toner resin and adding thereto a first and second magenta pigment, the improvement residing in selecting a first magenta pigment in an amount of from 0.5 to 1.1 weight percent and a second magenta pigment in an amount of from 2 to 7 percent by weight, and wherein said first magenta pigment is Pigment Red 81:3 with a CI number of 45160:3, and wherein the second magenta pigment is Pigment Red 122 with a CI number of 73915; a toner composition wherein the charge additive is an aluminum complex, a phenylcarboxylic acid, an aluminum hydroxide, a zinc complex, or a boron complex; a toner composition wherein the charge additive is hydroxy bis{3,5-tertiary butyl salicylic}aluminate monohydrate, bis{3,5-tertiary butyl salicylic}aluminum complex, bis{3,5-tertiary butyl salicylic}zinc complex, or bis{3,5-tertiary butyl salicylic}boron complex; and a toner composition comprised of resin particles, first magenta pigment particles of a molybdate silicate salt of rhodamine, and second magenta pigment particles of a 2,9-dimethylquanacridone, and wherein the first pigment is present in an amount of from about 0.5 to about 1 weight percent, and the second pigment is present in an amount of from about 1.5 to about 10 weight percent.

The pigment, FANAL PINK® (which is a Pigment Red 81:3), is present in the toner in an amount as indicated herein and preferably from about 0.5 to about 1.17 and more preferably 1.06 weight percent, and it is important that such concentrations be selected and remain substantially constant, as determined, for example, by the concentration of molybdenum in the pigment. FANAL PINK® contains an average of 29.8 percent molybdenum, thus the toners of the present invention in embodiments would contain between about 1,490 to about 3,487 ppm molybdenum for the percentages of 0.5 percent and 1.17 percent, respectively. A second pigment, which is a metal free magenta pigment, such as HOSTAPERM PINK EB™, that is Pigment Red 122, is present in an amount as indicated herein and preferably from about 1.5 to about 10.2 and more preferably 2.78 to 7.1 percent by weight depending on the mass of toner to be transferred to the paper. For example, when 0.9 milligram of toner per square centimeter is to be transferred, the preferred pigment concentrations, or amounts for a magenta toner are 1.06 weight percent of Pigment Red 81:3 and 2.78 weight percent of Pigment Red 122. When 0.55 milligram of toner per square centimeter is to be transferred, the preferred pigment concentrations for a magenta toner would be 1.06 weight percent of Pigment Red 81:3 and 4.55 weight percent of Pigment Red 122.

The toner compositions of the present invention can be prepared by a number of known methods, such as admixing and heating resin particles such as styrene butadiene copolymers, and the mixture of magenta pigment particles in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 10 microns, which diameters are determined by a Coulter Counter. Thereafter, the toner compositions can be classified utilizing, for example, a Donaldson Model B classifier for the purpose of removing fines, that is toner particles less than about 4 microns in volume median diameter.

Illustrative examples of suitable toner resins selected for the toner and developer compositions of the present invention in embodiments include polyamides, polyolefins, styrene acrylates, styrene methacrylates, styrene butadienes, crosslinked styrene polymers, polyesters, crosslinked polyesters epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide, mixtures thereof; and the like. Examples of specific thermoplastic toner resins include styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, and homopolymers of the aforementioned styrene polymers may be selected.

As one toner resin, there are selected the esterification products of a dicarboxylic acid and a diol comprising a diphenol. These resins are illustrated in U.S. Pat. No. 3,590,000, the disclosure of which is totally incorporated herein by reference. Other specific toner resins include styrene/methacrylate copolymers, and styrene/butadiene copolymers; PLIOLITES®; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, styrene acrylates, and mixtures thereof. Also, waxes with a molecular weight of from about 1,000 to about 7,000, such as polyethylene, polypropylene, and paraffin waxes, can be included in, or on the toner compositions as fuser roll release agents. Further, the reactive extruded polyesters of U.S. Pat. No. 5,376,494, the disclosure of which is totally incorporate herein by reference, can be selected as the toner resin.

The resin particles are present in a sufficient, but effective amount, for example from about 70 to about 95 weight percent. Thus, when 5 percent by weight of the pigment mixture is selected, about 95 percent by weight of resin is selected.

There can also be blended with the toner compositions of the present invention external additive particles including flow aid additives, which additives are usually present on the surface thereof. Examples of these additives include silicas such as AEROSIL® available from Degussa Chemicals, metal salts and metal salts of fatty acids inclusive of zinc stearate, aluminum oxides, cerium oxides, strontium titanates, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference.

Also, there can be included in the toner compositions of the present invention low molecular weight waxes, such as polypropylenes and polyethylenes commercially available from Allied Chemical and Petrolite Corporation, Epolene N-15 commercially available from Eastman Chemical Products, Inc., Viscol 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 5,000. Many of the polyethylene and polypropylene compositions useful in the present invention are illustrated in British Patent No. 1,442,835, the disclosure of which is totally incorporated herein by reference.

The low molecular weight wax components are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

For the formulation of developer compositions, there are mixed with the toner particles carrier components, particularly those that are capable of triboelectrically assuming an opposite polarity to that of the toner composition. Accordingly, the carrier particles of the present invention are selected to be of a negative polarity enabling the toner particles, which are positively charged, to adhere to and surround the carrier particles. Illustrative examples of carrier particles include iron, iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in embodiments in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166, and 4,935,326, the disclosures of which are totally incorporated herein by reference, including for example KYNAR® and polymethylmethacrylate, PMMA, mixtures (40/60). Coating weights can vary as indicated herein; generally, however, from about 0.3 to about 2, and preferably from about 0:5 to about 1.5 weight percent coating weight is selected.

Furthermore, the diameter of the carrier particles, preferably spherical or nonspherical in shape, is generally from about 50 microns to about 1,000, and preferably from about 70 to about 90 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier are selected.

The toner and developer compositions of the present invention may be selected for use in electrostatographic imaging apparatuses containing therein conventional photoreceptors. More specifically, the toner and developer compositions of the present invention can be selected for the development of images formed on layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The toner compositions are usually jetted and classified subsequent to preparation to enable toner particles with a preferred average diameter of from about 5 to about 20 microns, and more preferably from about 6 to about 10 microns. Also, the toner compositions of the present invention preferably possess a triboelectric charge of from about 0.1 to about 2 femtocoulombs per micron in embodiments thereof as determined by the known charge spectrograph. Admix time for the toners of the present invention are preferably from about 5 seconds to 1 minute, and more specifically, from about 5 to about 15 seconds in embodiments thereof as determined by the known charge spectrograph. These toner compositions with rapid admix characteristics enable, for example, the development of images in electrophotographic imaging apparatuses, which images have substantially no background deposits thereon, even at high toner dispensing rates in some instances, for instance exceeding 20 grams per minute; and further, such toner compositions can be selected for high speed electrophotographic apparatuses, that is those exceeding 70 copies per minute. Moreover, the toner compositions of the present invention can include therein, or thereon charge known charge additives as illustrated, for example, in the patents mentioned herein, such as aluminum complexes, a phenylcarboxylic acid, ALOHAS, an aluminum salt of substituted carboxylic acid, TRH®, a metal complex of azo dye, and the like. The charge additive or mixtures thereof in embodiments are selected for the toner in various effective amounts, such as for example from about 0.1 to about 5, and preferably from about 1 to about 3 weight percent.

In embodiments, the toner composition of the present invention possesses a stable triboelectric charge of from about 10 to about 40 microcoulombs per gram.

The following Examples are being supplied to further define various species of the present invention. These Examples are intended to illustrate and not limit the scope of the present invention. Parts and percentages are by weight unless otherwise indicated.

EXAMPLE I

A magenta toner was prepared as follows: 84.35 parts by weight of a bisphenol fumarate polyester resin, (SPAR®) obtained from Resana of Brazil, and 2.65 parts of a mixture of 1.06 part of FANAL PINK® pigment obtained from BASF Corporation and 1.59 parts of the polyester (SPAR®) resin, and 13.0 parts of a mixture of 4.55 parts SUNFAST MAGENTA® pigment (a Pigment Red 122) obtained from Sun Chemical, and 8.45 parts of the polyester resin were melt blended at approximately 80 to 120° C. in an extruder, followed by micronization and air classification to yield toner particles of an average particle diameter size of 9 microns in volume average diameter and 7 microns in number average diameter, as measured on the Coulter Counter particle size analyzer.

Subsequently, carrier particles were prepared by solution coating a Hoeganoes Anchor Steel core with a particle diameter range of from about 75 to about 150 microns, available from Hoeganoes Company, with 0.6 part by weight of a coating comprising 20 parts by weight of VULCAN® carbon black, available from Cabot Corporation, homogeneously dispersed in 80 parts by weight of polymethylmethacrylate, which coating was solution coated from toluene. A developer was prepared by selecting 4 parts of the above prepared toner and blending it with 100 parts of the above prepared carrier by roll milling for a period of about 30 minutes which resulted in a developer with a toner exhibiting a triboelectric charge of a negative −2.29 microcoulombs per gram as measured in a Faraday Cage.

Comparative Example 1A

A magenta toner was prepared as follows: 87.0 parts by weight of bisphenol fumarate polyester resin (SPAR®), obtained from Resana of Brazil, and 13.0 parts of a mixture of 4.55 parts of SUNFAST MAGENTA® pigment (a Pigment Red 122) obtained from Sun Chemical, and 8.45 parts of the above SPAR® polyester resin were melt blended at approximately 80 to 120° C. in an extruder, followed by micronization and air classification to yield toner particles of an average particle diameter size of 9 microns in volume average diameter and 7 microns in number average diameter, as measured on the Coulter Counter particle size analyzer.

Subsequently, carrier particles were prepared by solution coating a Hoeganoes Anchor Steel core with a particle diameter range of from about 75 to about 150 microns, available from Hoeganoes Company, with 0.6 part by weight of a coating comprising 20 parts by weight of VULCAN® carbon black, available from Cabot Corporation, homogeneously dispersed in 80 parts by weight of polymethylmethacrylate, which coating was solution coated from toluene. A developer was prepared by selecting 4 parts of the above prepared toner and blending it with 100 parts of the above prepared carrier by roll milling for a period of about 30 minutes which resulted in a developer with a toner exhibiting a triboelectric charge of −8.89 microcoulombs per gram as measured in a Faraday Cage.

Comparative Example 1B

A magenta toner was prepared as follows: 92.5 parts by weight of bisphenol fumarate polyester resin (SPAR®), obtained from Resana, and 7.5 parts of a mixture of 3 parts of FANAL PINK® pigment obtained from BASF Corporation and 4.5 parts of the SPAR® polyester resin were melt blended at approximately 80° to 120° C. in an extruder, followed by micronization and air classification to yield toner particles of an average particle diameter size of 9 microns in volume average diameter and 7 microns in number average diameter, as measured on the Coulter Counter particle size analyzer.

Subsequently, carrier particles were prepared by solution coating a Hoeganoes Anchor Steel core with a particle diameter range of from about 75 to about 150 microns, available from Hoeganoes Company, with 0.6 part by weight of a coating comprising 20 parts by weight of VULCAN® carbon black, available from Cabot Corporation, homogeneously dispersed in 80 parts by weight of polymethylmethacrylate, which coating was solution coated from toluene. A developer was prepared by selecting 4 parts of the above prepared toner and blending it with 100 parts of the above prepared carrier by roll milling for a period of about 30 minutes which resulted in a developer with a toner exhibiting a triboelectric charge of −2.34 microcoulombs per gram as measured in a Faraday Cage.

EXAMPLE II

The above three Examples of toners were deposited on a filter paper patch such that the amount of toner of each patch was equal to 0.55 milligram/cm$^2$. Each patch was fused in a Xerox test envelope fuser. The resulting patches were measured on the Diano Match Scan II and the color determined within a CIE LAB color space, see for example F. Billmeyer's book *Principles of Color Technology*, 2nd Edition pp. 59–65, where color is defined by: metric lightness, L*; redness or greenness, a*; yellowness or blueness, b*; chroma, C*; and hue angle, h. Table 1 includes the results of these measurements indicating that the blend toner from Example I occupies a point in color space very close to that of the toner of Comparative Example 1B with just Pigment Red 81:3 and much closer than the toner of Comparative Example 1A with Pigment Red 122 alone.

TABLE 1

| TONER | a* | b* | h | C* | L* |
|---|---|---|---|---|---|
| Example I Blend | 79.95 | −16.40 | 348.41 | 81.62 | 49.21 |
| Comparative Example 1B PR 81:3 | 81.71 | −20.79 | 345.81 | 84.33 | 56.45 |
| Comparative Example 1A PR 122 | 68.09 | −18.93 | 344.46 | 70.68 | 56.32 |

EXAMPLE III

When the EPA test method 3050 revised in 1987 (this test is "Acid Digestion Of Sludges" used to determine what leachable amount of certain heavy metals was waste.) was applied to the toner in Comparative Example 1B prepared with just FANAL PINK® pigment, all of the molybdenum present was found, and the toner was found to contain 8,900 ppm of molybdenum from the Pigment Red 81:3. The Total Threshold Limit Concentration (TTLC) from the California waste disposal requirements was believed to be 3,500 ppm. The toner from Example I, prepared with the combination of Pigment 122 and the amount of FANAL PINK® pigment indicated contained only 3,160 ppm molybdenum.

EXAMPLE IV

The toner from Example I was blended with the following surface additives: 0.3 weight percent of TS530, a hexamethyldisilizane treated fumed silica obtained from Cabot Corporation, and 0.3 weight percent of ZINC STEARATE L™ obtained from Synthetic Products Company and 0.6 weight percent of P25, a titanium dioxide from Degussa. The toner from Comparative Example 1A was blended with the following surface additives; 0.6 weight percent of AEROSIL R972®, a colloidal silica obtained from Degussa, 0.3 weight percent of Zinc Stearate L obtained from Synthetic Products Company, 0.6 weight percent of P25, a titanium dioxide from Degussa, and 0.1 weight percent E-84™, a negative charge additive from Orient Chemical. The toner from Comparative Example 1B was blended with the following surface additives; 0.6 weight percent of TS530, a hexamethyldisilizane treated fumed silica obtained from Cabot Corporation, 0.3 weight percent of ZINC STEARATE L™ obtained from Synthetic Products Company and 0.6 weight percent of P25, a titanium dioxide from Degussa. Developers were then prepared using the same carrier as described in the above Examples. These developers were then tested in a breadboard fixture that simulates a machine developer housing, and wherein the development process speed was 40 copies per minute. After 6 hours, equivalent to 14,400 copies, samples were taken from the developer housing for charge spectrograph analysis at 200 volts/centimeter. The table below indicates the amounts of Corrected Wrong Sign (CWS) toner (positive charge) and Corrected Low Charge (CLC) toner found in the samples from each developer. The results show a significant improvement in the amount of CLC toner for the toners containing Pigment Red 122 and the blend of Pigment Red 122 and Pigment Red 81:3. A higher value of CLC normally translates into higher image background and higher toner consumption in xerographic imaging test fixtures.

TABLE 2

| TONER | Tribo 0 hrs. | Tribo −6 hrs. | CSW % | CLC %[a] <0.2 |
|---|---|---|---|---|
| Example 1a PR 81:3 | 15.0 | 28.9 | 2.05 | 28.29 |
| Example 1b PR 122 | 16.4 | 29.30 | 2.43 | 20.05 |
| Example I Blend | 15.1 | 25.10 | 1.70 | 19.73 |

a < 0.2 femtocoulombs/micron

Other modifications of the present invention may occur to those skilled in the art subsequent to a review of the present application, and these modifications, including equivalents thereof, are intended to be included within the scope of the present invention.

What is claimed is:

1. A toner composition consisting essentially of resin particles, first magenta pigment particles of a molybdate silicate salt of rhodamine, second magenta pigment particles of a 2,9-dimethylquinacridone, and a negative charge enhancing additive; and wherein the first pigment is present in an amount of from about 0.5 to about 1.2 weight percent, and the second pigment is present in an amount of from about 1.5 to about 10.2 weight percent.

2. A toner composition according to claim 1, wherein the first pigment is present in an amount of from about 0.8 to about 1.1 weight percent, and the second pigment is present in an amount of from about 1.8 to about 7.9 weight percent; and wherein said molybdate silicate salt of rhodamine is Pigment Red 81:3 with a Cl number of 45160:3.

3. A toner composition in accordance with claim 2 with an admix time of from less than about 15 seconds.

4. A toner composition in accordance with claim 2 with an admix time of from about 1 to about 14 seconds.

5. A toner composition in accordance with claim 2 with a stable triboelectric charge of from about 10 to about 40 microcoulombs per gram.

6. A toner composition in accordance with claim 2 wherein the resin particles are comprised of styrene polymers, polyesters, or mixtures thereof.

7. A toner composition in accordance with claim 2 wherein the resin particles are comprised of styrene acrylates, crosslinked polyesters, styrene methacrylates, or styrene butadienes.

8. A toner composition in accordance with claim 2 further containing a wax component with a weight average molecular weight of from about 1,000 to about 10,000.

9. A toner composition in accordance with claim 8 wherein the wax component is selected from the group consisting of polyethylene and polypropylene.

10. A toner composition in accordance with claim 2 further containing as external additives metal salts of a fatty acid, metal oxides, silicas, or mixtures thereof.

11. A developer composition comprised of the toner composition of claim 2 and carrier particles.

12. A developer composition in accordance with claim 11 wherein the carrier particles are comprised of ferrites, steel, or an iron powder.

13. A developer composition in accordance with claim 11 wherein the carrier particles are comprised of a core with a polymer coating thereover.

14. A method of imaging which comprises formulating an electrostatic latent image on a negatively charged photoreceptor, affecting development thereof with the toner composition of claim 2, and thereafter transferring the developed image to a substrate.

15. A toner in accordance with claim 2 wherein said first pigment is present in an amount of 1.06 weight percent.

16. A toner in accordance with claim 2 wherein said toner contains 3,160 parts per million of molybdenum.

17. A toner composition in accordance with claim 1 wherein the charge additive is present in an amount of from about 0.05 to about 5 weight percent.

18. A developer composition comprised of the toner composition of claim 1 and carrier particles.

19. A method of imaging which comprises formulating an electrostatic latent image on a photoreceptor, affecting development thereof with the toner composition of claim 1, and thereafter transferring the developed image to a substrate.

20. A toner composition in accordance with claim 1 wherein the charge additive is an aluminum complex, a phenylcarboxylic acid, an aluminum hydroxide, a zinc complex, or a boron complex.

21. A toner composition in accordance with claim 1 wherein the charge additive is hydroxy bis{3,5-tertiary butyl salicylic}aluminate monohydrate, bis{3,5-tertiary butyl salicylic}aluminum complex, bis{3,5-tertiary butyl salicylic}zinc complex, or bis{3,5-tertiary butyl salicylic}boron complex.

22. A toner composition in accordance with claim 1 wherein the first pigment is present in an amount of 0.5 to 1.2 weight percent and the second pigment is present in an amount of 1.5 to 10.2 weight percent.

23. A toner composition according to claim 1, wherein the first pigment is present in an amount of from about 0.5 to about 1 weight percent, and the second pigment is present in an amount of from about 1.5 to about 10 weight percent.

24. A toner composition in accordance with claim 1 further containing surface additives.

25. A toner in accordance with claim 1 wherein said first pigment is Pigment Red 81:3 and is present in an amount of 0.5 to 1.17 weight percent, and said second magenta pigment is present in an amount of 2.78 to 7.1 weight percent.

* * * * *